United States Patent [19]

Walker et al.

[11] Patent Number: 4,505,308

[45] Date of Patent: Mar. 19, 1985

[54] SEALING DEVICE FOR LIQUID DISPENSING NOZZLES WHICH RECOVER VAPOR HAVING CONDUIT INTERNAL TO FILLPIPE

[75] Inventors: Donald C. Walker, Munster, Ind.; Irwin Ginsburgh, Morton Grove, Ill.

[73] Assignee: Standard Oil Company (Indiana), Chicago, Ill.

[21] Appl. No.: 14,295

[22] Filed: Feb. 23, 1979

Related U.S. Application Data

[63] Continuation of Ser. No. 879,761, Feb. 21, 1978, abandoned, which is a continuation of Ser. No. 642,582, Dec. 19, 1975, abandoned.

[51] Int. Cl.[3] ..... B65B 3/18

[52] U.S. Cl. ..... 141/59; 141/287; 141/311 R

[58] Field of Search ..... 141/52, 59, 93, 97, 141/287, 290, 311 R, 346, 392; 277/34.3, 226

[56] References Cited

U.S. PATENT DOCUMENTS

| | | | |
|---|---|---|---|
| 2,908,299 | 10/1959 | Gosselin | 141/287 |
| 3,550,987 | 12/1970 | Dickey | 277/226 X |
| 3,805,857 | 4/1974 | Johnson | 141/287 |
| 3,828,116 | 8/1975 | Lonow | 277/34.3 X |
| 3,830,267 | 8/1974 | Cass | 141/290 |
| 3,845,792 | 11/1974 | Johnson | 141/290 |
| 3,897,088 | 7/1975 | Beinhaur | 277/34.3 X |
| 3,897,810 | 8/1975 | Arnett et al. | 141/346 |
| 3,989,072 | 11/1976 | Voelz et al. | 141/311 R |

FOREIGN PATENT DOCUMENTS

| | | | |
|---|---|---|---|
| 1292909 | 4/1962 | France | 141/290 |

*Primary Examiner*—Stephen Marcus

*Attorney, Agent, or Firm*—Ekkehard Schoettle; William T. McClain; William H. Magidson

[57] ABSTRACT

A sealing member capable of elastic deformations provides a seal from the atmosphere between the mouth of a fillpipe and a liquid dispensing nozzle having vapor recovery conduit means internal to the receptive fillpipe, typically for use with gasoline.

8 Claims, 3 Drawing Figures

SEALING DEVICE FOR LIQUID DISPENSING NOZZLES WHICH RECOVER VAPOR HAVING CONDUIT INTERNAL TO FILLPIPE

This is a continuation of application Ser. No. 879,761, filed Feb. 21, 1978, now abandoned which is a continuation of application Ser. No. 642,582, filed Dec. 19, 1975 (now abandoned).

BACKGROUND OF THE INVENTION

In the near future, Federal and state regulating agencies will require that most of the vapors from automobile refueling operations be recovered. Numerous nozzles have been described for recovery of the gasoline vapor produced in filling automobiles; representative are U.S. Pat. No. 3,866,636 (Lasater, 1975) and U.S. Pat. No. 3,710,831 (Reigel, 1973) which are incorporated herein by references. Of less relevance is U.S. Pat. No. 8,830,267 (Cass, 1974). However, the effectiveness of those nozzles is limited because automobile gasoline tank fillpipes are not standardized in configuration and the attempt to prevent the escape of vapor from the mouth of the fillpipe with a seal has been plagued by consequent geometric and mechanical failure.

The least expensive installation at a service station for recovering gasoline vapors displaced during fueling of automobiles is direct displacement from the car tank and return to the service station's underground supply tank. A successful displacement system requires a reliable, vapor-tight seal between the vapor recovery nozzle and the mouth of the car's fillpipe. Previous vapor recovery nozzles, notably those nozzles described in the aforementioned patents, are capable of making adequately sealed connections on some cars but do not have sealing means of sufficient surface pliancy and conformability to insure a good seal.

SUMMARY OF THE INVENTION

In contrast to previous nozzles having vapor recovery conduit means internal to receptive fillpipe, the present invention comprises a nozzle having a sealing means capable of elastic non-uniform deformation in three dimensions which allows the sealing means to conform to variation in the contour of the mouth of the fillpipe while at the same time providing additional non-uniform deformation to correct for relative misalignment between the mouth of the fillpipe and the spout and nozzle. The ability for non-uniform compression or deformation provides the sealing means with the surface pliancy and three dimensional flexibility necessary to insure a fluid-tight seal with geometric and mechanical accommodation.

DETAILED DESCRIPTION OF THE INVENTION

Figure 1:
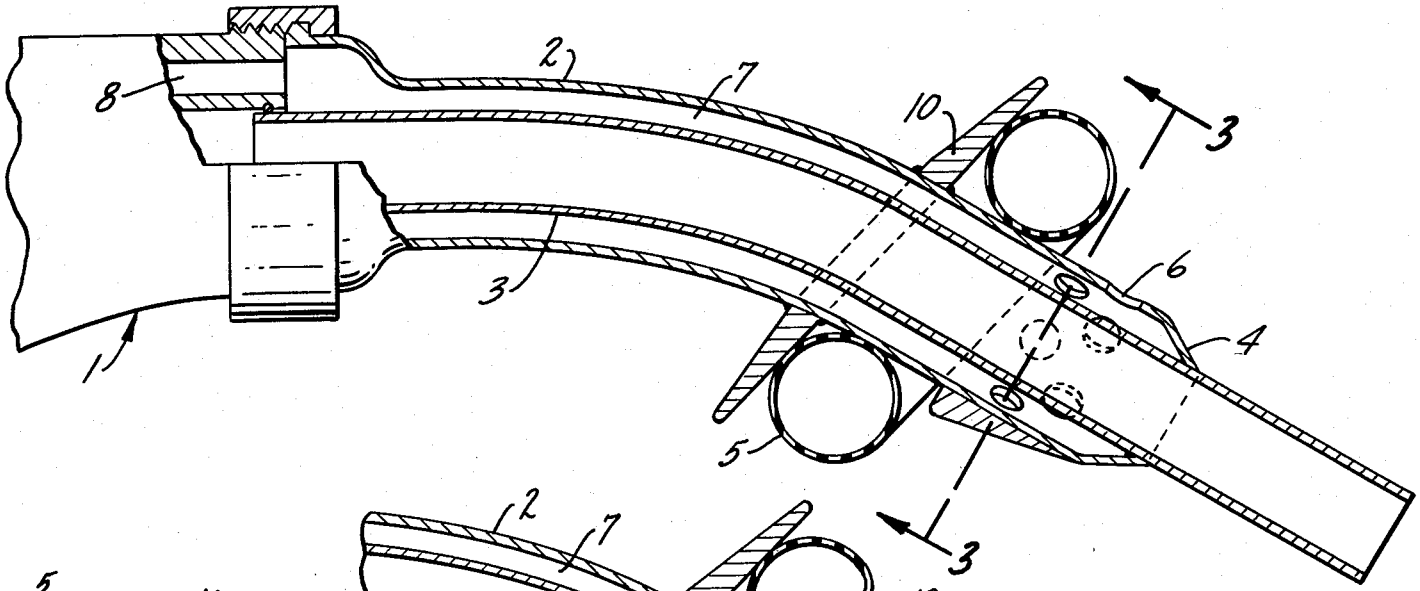
FIG. 1 presents a side elevation with parts in section of the nozzle and sealing member.

The surface of the sealing member, which abuts the mouth of the fillpipe, should approximate the shape of a torus (as shown in FIG. 1) whether the nozzle has a vapor recovery conduit means internal to the sealed fillpipe such as that described in the aforementioned U.S. Pat. No. 3,710,831 or whether the conduit means is external to the sealed fillpipe such as that described in the aforementioned U.S. Pat. No. 3,866,636. The torus or "donut" shape is the most practical for the sealing member because it provides naturally flexible curvature in every direction, permitting the curvature in both the inner and the outer periphery of the torus to provide lateral sealing and deformation surface, as well as the leading face, for abutment of the mouth of a fillpipe, particularly under conditions of relative misalignment between the mouth of the fillpipe and the sealing member of the nozzle. Though not as effective as the torus shape, a truncated hollow cylinder would be a useful sealing member. The sealing member should be fabricated from supple, pliant material such as elastomer or fabric and it is preferable that it be partially filled with air or filled with other elastically compressible support such as sponge, polyurethane foam or like material. A developmental sealing member was adapted from an underinflated model airplane tire. Viton and neoprene are suitable elastomers, and fillers such as glass, fibers, or beads would provide the sealing member with added durability.

Figure 2:
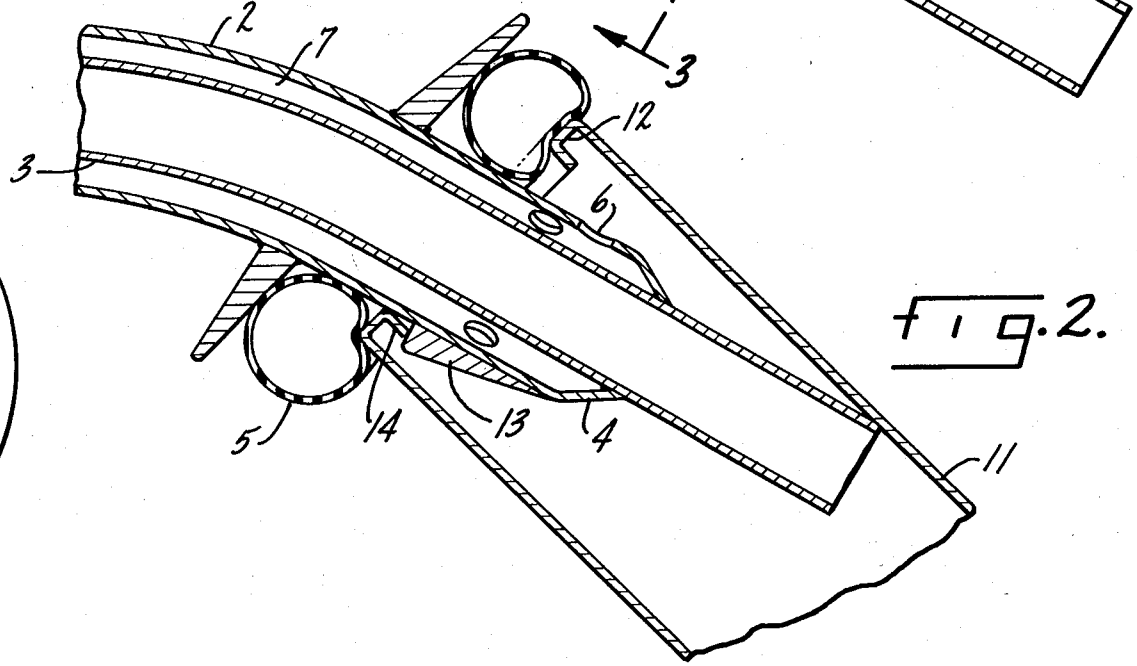
FIG. 2 presents a side elevation with parts in section of the nozzle inserted into a fillpipe, typically of an automobile.
Figure 3:
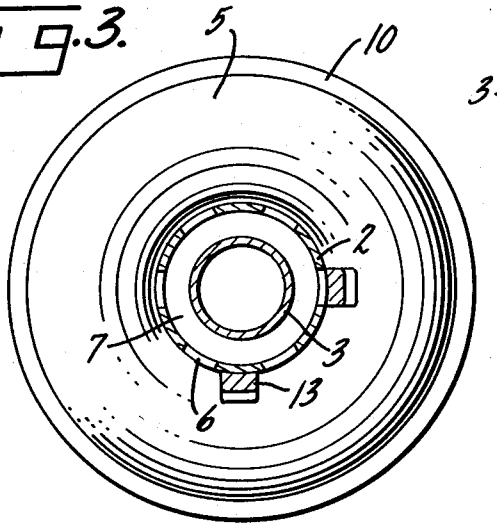
FIG. 3 shows a section substantially along 3—3 of FIG. 1.

Without indicating any limitation upon the scope of the claims, a preferred embodiment of the nozzle and sealing member are shown in FIGS. 1, 2, and 3. FIGS. 1 and 2 show a nozzle 1 having an outer sheath 2 that extends about ⅔ down the inner gasoline dispensing tube 3 which has an inner diameter of approximately ⅝ inch. The sheath terminus 4 may or may not be sealed but it is preferred that it be sealed for strength. When the sheath terminus 4 is sealed there are provided approximately twelve ¼ inch holes 6 in two or more rows distributed around the circumference between the sheath terminus 4 and sealing member 5 for entrance of the vapor. Multiple rows of holes will allow a flow profile such that vapors flowing upward in proximity to the wall of the fillpipe which avoid the lowest row of holes will enter the holes in a higher row and the overall result will be a minimized restriction and pressure drop. The annular space 7 between the sheath 2 and the inner tube 3 is approximately 1/16 to 3/32 inch in width. The collective area of the holes should equal or exceed the cross-sectional area of the annular space 7. The vapor travels up the annular space 7 between the sheath 2 and the inner tube 3 through the vapor return channel 8 that is molded into the body of nozzle 1.

Flange 10 is mounted on sheath 2 to provide support for sealing member 5. While sealing member 5 may be detachably mounted on sheath 2 so as to tightly slide into sheath 2 to the point where it snugly abuts flange 10 as well as sheath 2, the sealing member 5 could also be securely bonded to either or both flange 10 and sheath 2. The sealing member could have a hemi-torus shape with a back surface conforming to and abutting flange 10 which could facilitate a bond therebetween without severe sacrifice in the flexibility of a full torus sealing member.

Flange 10 should be mounted at a slight angle of approximately 15° from normal to the sheath 2 depending on the curvature and length of tube 3. Flange 10 could itself have curvature and could be mounted to allow a slight degree of pivot (not shown). Instead of a flange, other sealing member support structures can be used such as a conventional coil spring apparatus.

When the nozzle 1 is inserted into a fillpipe 11 as shown in FIG. 2, the sealing member 5 seats firmly against the mouth 12 of fillpipe 11 and one or more latches 13 mounted on the sheath 2 engage the lip 14 of the mouth 12 to maintain the seal and to retain the nozzle 1 within the fillpipe 11. The latches 13 and sheath-terminus 4 are tapered to provide easy entry into the fillpipe. The latches 13 could be replaced by a conventional collar or by a half-collar on the lower periphery of the sheath.

The sealing member can be used on a nozzle having a vapor recovery conduit means which is external to a receptive fillpipe such as the conduit means described in the aforementioned U.S. Pat. No. 3,866,636. An embodiment of of the sealing member on a nozzle having a vapor recovery conduit means external to receptive fillpipes is more particularly shown and described in the copending patent application of IRWIN GINSBURGH, Ser. No. 244,220 filed Mar. 16, 1981 which is a continuation of Ser. No. 907,538, filed Feb. 21, 1978, now abandoned, and assigned commonly.

It will be clear from the foregoing that the present invention is expected to find its primary utility in preventing the escape of fumes such as gasoline vapor or chemical vapors. However, it will be understood by those skilled in the art that it may also advantageously be applied to prevent the escape of dust or other residue in connection with the transfer of any fluent material.

We claim:

1. A curved liquid dispensing nozzle adapted for misaligned insertion into a fillpipe having a vapor recovery conduit means which is internal to the mouth of said fillpipe when the nozzle is inserted wherein the improvement comprises a three-dimensionally flexible sealing member having the curvature of approximately torus shape, an external diameter greater than the external diameter of said fillpipe and an internal diameter smaller than the internal diameter of said fillpipe whereby the curvature in the inner and the outer periphery of the torus provides lateral sealing and deformation surface, said sealing member having the capacity for elastic nonuniform deformation in three dimensions and providing a seal from the atmosphere between the misaligned nozzle and the abutting mouth of the fillpipe when said nozzle is inserted therein.

2. The nozzle of claim 1 wherein the sealing member is filled with elastically compressible support.

3. The nozzle of claim 1 wherein the conduit means comprises the annular space between an inner dispensing tube and an outer sheath.

4. The nozzle of claim 3 wherein the outer sheath has one or more holes for entry of the vapor.

5. The nozzle of claim 4 wherein the holes are located in one or more rows.

6. The nozzle of claim 1 having a support structure means supporting the sealing member.

7. The nozzle of claim 6 wherein the support structure means comprises a flange.

8. A curved liquid dispensing nozzle adapted for misaligned engagement within a fillpipe and having a vapor recovery conduit means which is internal to the mouth of said fillpipe when the nozzle is inserted wherein the improvement comprises a three-dimensionally flexible sealing member having an external diameter greater than the external diameter of said fillpipe, an internal diameter smaller than the internal diameter of said fillpipe, the curvature of approximately torus shape and being capable of elastic nonuniform deformation in three dimensions which provides a seal from the atmosphere between the nozzle and the misaligned mouth of the fillpipe.

* * * * *

UNITED STATES PATENT OFFICE
CERTIFICATE OF CORRECTION

Patent No. 4,505,308 Dated March 19, 1985

Inventor(s) Donald C. Walker and Irwin Ginsburgh

It is certified that error appears in the above-identified patent and that said Letters Patent are hereby corrected as shown below:

Column 1, line 20, "8,830,267" should read --3,830,267--

Column 3, line 15, "of of" should read --of--

Signed and Sealed this

*Third* Day of *September 1985*

[SEAL]

*Attest:*

DONALD J. QUIGG

*Attesting Officer* *Acting Commissioner of Patents and Trademarks - Designate*